US007673432B2

(12) United States Patent
Teng

(10) Patent No.: US 7,673,432 B2
(45) Date of Patent: Mar. 9, 2010

(54) DOUBLE-SKIN TUBULAR STRUCTURAL MEMBERS

(75) Inventor: Jin-Guang Teng, Hong Kong (CN)

(73) Assignee: The Hong Kong Polytechnic University, Hong Kong (CN)

( * ) Notice: Subject to any disclaimer, the term of this patent is extended or adjusted under 35 U.S.C. 154(b) by 788 days.

(21) Appl. No.: 10/797,045

(22) Filed: Mar. 11, 2004

(65) Prior Publication Data

US 2005/0229532 A1 Oct. 20, 2005

(51) Int. Cl.
*E04B 1/00* (2006.01)
*E04G 21/00* (2006.01)

(52) U.S. Cl. ..... 52/745.17; 52/745.09; 52/745.19; 52/843; 428/36.1; 138/140; 138/145; 138/146

(58) Field of Classification Search ..... 52/169.9, 52/155, 169.13–169.14, 170, 632, 720.1, 52/721.1, 721.4, 724.5, 726.2, 732.1, 737.3, 52/737.4, 737.5, 738.1, 745.17, 745.09, 745.19, 52/843, 849, 831; 428/36.1; 138/140, 172, 138/145–146

See application file for complete search history.

(56) References Cited

U.S. PATENT DOCUMENTS 1,996,951 A * 4/1935 Clark et al. ..... 156/429
2,016,273 A * 10/1935 Atwood ..... 428/106
2,061,825 A * 11/1936 Bly ..... 427/384
3,429,758 A * 2/1969 Young ..... 156/79
3,755,029 A * 8/1973 Ellis et al. ..... 156/71
4,142,555 A * 3/1979 Satake et al. ..... 138/143
4,169,906 A * 10/1979 Hallstrom et al. ..... 427/183
4,592,886 A * 6/1986 Mannherz ..... 264/262
4,709,948 A * 12/1987 Archer et al. ..... 285/381.1
5,324,248 A * 6/1994 Quigley ..... 492/50
5,389,692 A * 2/1995 Bertram ..... 521/51
5,543,188 A * 8/1996 Te'eni ..... 428/36.6
5,599,599 A * 2/1997 Mirmiran et al. ..... 428/36.3
5,638,871 A * 6/1997 Iorio et al. ..... 138/146
5,914,163 A * 6/1999 Browne ..... 428/36.1
5,972,450 A * 10/1999 Hsich et al. ..... 428/35.9
6,082,061 A * 7/2000 Ryan ..... 52/188
6,082,063 A * 7/2000 Shrive et al. ..... 52/223.13
6,123,485 A * 9/2000 Mirmiran et al. ..... 405/252
6,151,743 A * 11/2000 Church et al. ..... 14/73
6,363,681 B1 * 4/2002 Neuner ..... 52/723.1
6,427,403 B1 * 8/2002 Tambakis ..... 52/309.1
6,689,440 B2 * 2/2004 Hsich et al. ..... 428/36.91
6,832,454 B1 * 12/2004 Iyer ..... 52/223.4

FOREIGN PATENT DOCUMENTS

JP 61028630 A * 2/1986
JP 91059214 B * 9/1991

* cited by examiner

*Primary Examiner*—Jeanette E. Chapman
(74) *Attorney, Agent, or Firm*—Buchanan Ingersoll & Rooney PC

(57) ABSTRACT

This invention provides double-skin tubular structural members having fiber-reinforced polymer outer tubes, steel or otherwise generally metallic inner tubes and generally a bound aggregate such as concrete in between the tubes.

5 Claims, 3 Drawing Sheets

| Specimen | Number of FRP layers | Inner steel tube |
|---|---|---|
| DS11 | One | D/t=76/3.22 |
| DS12 | One | D/t=76/3.22 |
| DS21 | Two | D/t=76/3.22 |
| DS22 | Two | D/t=76/3.22 |
| DS31 | Three | D/t=76/3.22 |
| DS32 | Three | D/t=76/3.22 |

| Label | Pco (kN) | Ps (kN) | Pc (kN) | Ave Pc (kN) | fcc (MPa) | fcc/fco | $\varepsilon_a(\times 10^{-6})$ | Ave $\varepsilon_a(\times 10^{-6})$ | $\varepsilon_a / \varepsilon_{co}$ |
|---|---|---|---|---|---|---|---|---|---|
| DS11 | 543.58 | 282.6 | 793.75 | 811.51 | 38.86 | 0.98 | 14208 | 14542 | 5.53 |
| DS12 | | | 829.27 | | | | 14875 | | |
| DS21 | | | 1044.15 | 1034.47 | 55.24 | 1.39 | 22000 | 20204 | 7.69 |
| DS22 | | | 1024.79 | | | | 18417 | | |
| DS31 | | | 1214.07 | 1207.99 | 68.00 | 1.71 | 23666 | 23541 | 8.96 |
| DS32 | | | 1201.91 | | | | 23416 | | |

fco — unconfined concrete strength;

Pco --- calculated ultimate load of unconfined concrete

Ps --- calculated ultimate load of inner steel tube

Pc --- ultimate load obtained in the test fcc --- calculated confined concrete strength $\varepsilon_a$ --- ultimate axial strain of DSTCs $\varepsilon_{co}$ --- strain at peak stress of unconfined concrete

Fig. 5

DOUBLE-SKIN TUBULAR STRUCTURAL MEMBERS

FIELD OF THE INVENTION

This invention relates to double-skin tubular structural members such as columns and methods of making such structural members.

BACKGROUND TO THE INVENTION

A variety of composite materials are known to be used in the formation of structural members used as columns, beams, beam-columns, etc. in various structures such as bridges or buildings.

Existing column forms include double-skin steel tubular columns consisting of an inner steel tube, an outer steel tube and with concrete in between the tubes. However, the use of a composite column in this form may lead to difficulties with fire protection for the outer tube if this steel tube is to be used in a structural manner during normal loading of the column and difficulties with corrosion protection of the outer tube. Additionally, columns utilizing inner and outer steel tubes may be relatively heavy.

Lighter and more durable forms are known in the form of double-skin fibre reinforced polymer tubular columns. However, such columns may not be as useful to support construction loading during formation of the columns until the concrete is set and provide difficulties for the connection of beams to such columns.

OBJECT OF THE INVENTION

It is an object of the present invention to provide a double-skin tubular structural member and methods of making such structural members that may overcome or alleviate some of the difficulties with the prior constructions or at least provide the public with a useful choice.

SUMMARY OF THE INVENTION

Accordingly, in a first aspect, the invention may broadly be said to consist in a double-skin tubular structural member including:

a fibre reinforced polymer outer tube;

an inner tube made from generally metallic materials; and filler material provided between said outer tube and said inner tube.

Preferably said filler material comprises a bound aggregate material.

Preferably said bound aggregate material comprises concrete.

Preferably said inner tube comprises a steel tube, Preferably said fibre-reinforced polymer includes at least some fibres orientated generally circumferentially around said tube.

Preferably said fibre-reinforced polymer includes a majority of fibres being orientated generally circumferentially about said tube.

Preferably said outer fibre-reinforced polymer tube is constructed from a plurality of layers of fibre-reinforced polymer.

Alternatively or additionally, said outer fibre-reinforced polymer tube is constructed using a filament winding process.

BRIEF DESCRIPTION OF THE DRAWINGS

Preferred embodiments of the invention will now be described with reference to the following drawings in which:

FIG. 5 provides a table of results in calculations for the results shown in FIG. 4.

DETAILED DESCRIPTION OF PREFERRED EMBODIMENTS

This invention relates to double-skin tubular structural members. In general, the reference to double-skin is a reference to inner and outer tubular members, generally provided with a filler in between.

Throughout the majority of the description, reference will be made to double-skin tubular columns or DSTC's. Although a generic reference to columns is used, it will be appreciated that these structural members can also operate as beams with or without rearrangement. Therefore, although reference may be used to columns, this should be construed as also incorporating the variety of structural members such as beams and columns as well as other structural members having similar requirements.

Figure 1:
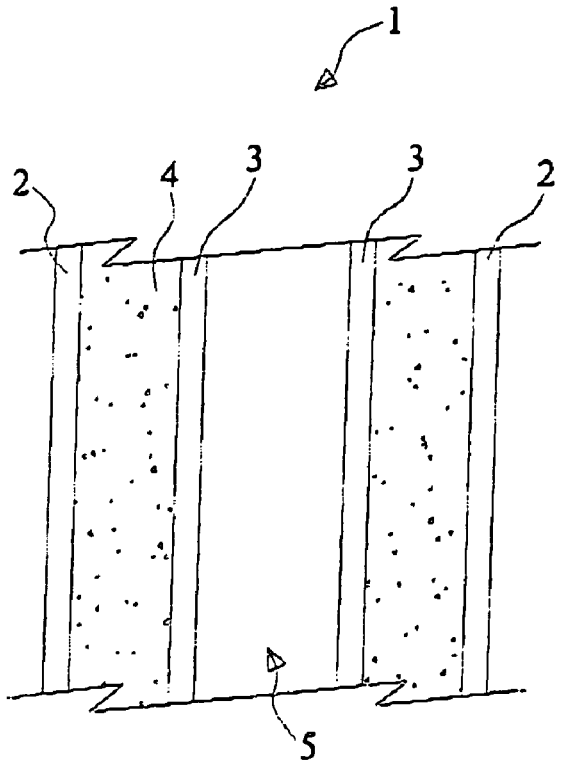
FIG. 1 shows a cross-sectional elevation of a structural member in accordance with one embodiment of the invention.

Referring to FIG. 1, a first embodiment of the invention is shown in the form of a structural member 1 such as a column including a fibre-reinforced polymer outer tube. The reference to fibre-reinforced polymer composites is intended to include such composites formed by embedding generally continuous fibres in a resin matrix which binds the fibres together.

Typically, fibres utilized in fibre-reinforced polymer (FRP) include carbon, glass and aramid fibres while common resins would include epoxy, polyester and vinyl ester resins. Of course, this is not an exhaustive list of the fibres and polymers that may be used in such composites although these may be suitable for the present applications.

Again referring to FIG. 1, a structural member 1 is provided with an inner tube in the form of, in this particular embodiment, a steel tube 3. Again, although reference to steel may be used throughout the description of preferred embodiments as it is a common construction material, a variety of other metallic or similar isotropic materials having good post-yield ductility may be utilized. Steel is merely a common example of such materials.

Intermediate of the outer tube 2 and the inner tube 3 is a filler material 4. The filler material 4 may comprise a variety of materials although preferred filler materials may include a bound aggregate such as concrete to provide suitable compression strength to the column.

In this preferred embodiment, the inside of the inner tube 3 may be left hollow although this is only a preferred solution such that the weight of the structural member is reduced and the inside of the tube may allow access to the steel tube 3 for the interconnection of beams or the passage of building services components. In other applications, the inner tube itself may be filled with a filler material of its own which may be the same or different from that utilized intermediate of the two tubes. Furthermore, if desired, the inner tube may be coated to protect against any environmental hazard.

The tubes 2 and 3 in this preferred embodiment may be provided as substantially circular cross-sectional tubes although any other desired shape such as square, rectangular or more complex shapes may be utilized as desired.

Furthermore, in this preferred embodiment, the tubes are concentrically arranged. For a column in a building anticipating transverse loadings from wind load, earthquakes or similar, the column is often provided with the tube substantially concentrically arranged so as to accommodate load from any direction. However, should a structural member in this form be utilized as a beam, there may be specific preference to offset the inner tube 3 with respect to the central axis of the tube 2 so as to move the steel tube 3 more into this zone having the greatest axial tensile stress during normal beam loading.

To improve the performance of the fibre-reinforced polymer and its action within the structural member, it is preferred that at least some or, more preferably, a majority of the fibres are orientated generally circumferentially about the structural member and provide confinement to the concrete for enhanced ductility. It will be appreciated that the orientation of the fibres may be effected by the type of FRP used or by its method of manufacture. For example, if the FRP is constructed using a lattice of fibres, it may be desirable to orientate an axis of the lattice around the circumferential direction. If a filament winding process is used, a majority of the fibres will be generally circumferential but the winding process tends to align the fibres like a coil at some angle to the circumferential direction.

Experimental Data

To consider the performance of double-skin tubular columns having a steel inner tube, a fibrereinforced polymer outer tube and concrete in between, a total of six doubleskin tubular columns were prepared and tested under uni-axial compression.

Figures 3, 4:
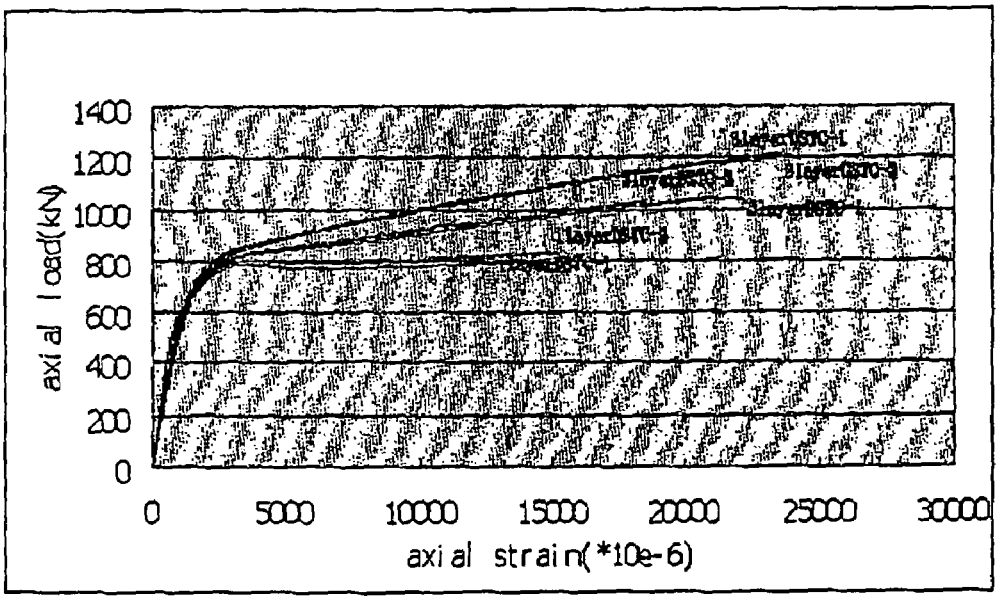
FIG. 3 shows a table of test samples in accordance with one embodiment of the invention.
FIG. 4 provides a graphical representation of axial load against axial strain upon testing of the samples detailed in FIG. 3.

The samples themselves were prepared with outer diameters of 152.5 mm. and height of 305 mm. Each had the same inner steel tube with a diameter of 76 mm. and thickness of 3.22 mm. However, the samples were prepared such that two samples ad a single layer of fibre-reinforced polymer on the outside, two such samples had two layers and the final two samples had three layers. A summary of the samples prepared is shown in FIG. 3.

Figure 2:
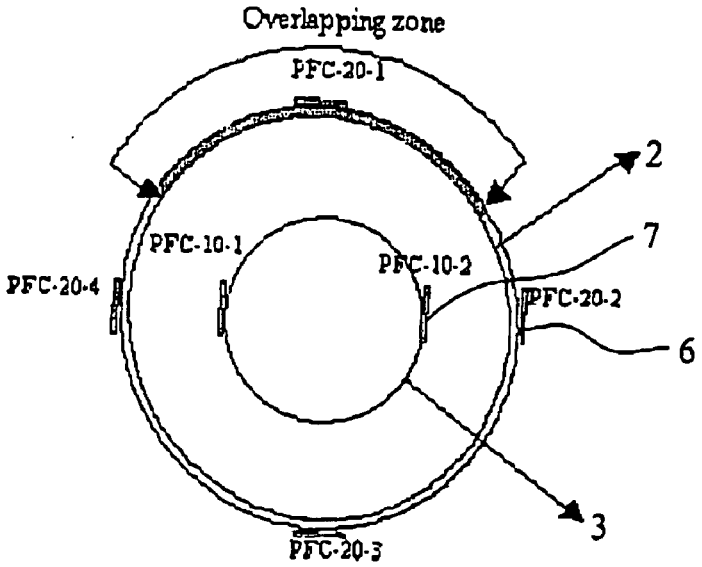
FIG. 2 shows a plan cross-section through a structural member used in testing an embodiment of the invention.

Each of the samples was tested under uni-axial compression with strain gauges attached to both the inner steel tube and the fibre-reinforced polymer tube. The strain gauges 6, 7 comprised two 10 mm. rosettes on the steel tube and four 20 mm. rosettes on the fibre-reinforced polymer outside tube for each specimen. A cross-section of the sample showing the position of the strain gauges is provided in FIG. 2.

The materials of the columns were such that identical steel tubes were utilized and samples tested under tension according to British standard 18:1987. The average tensile strength obtained was 380.4 MPA and the average Young's modulus was 207.28 GPA.

An additional three control concrete specimens with the same outer diameter of 152.5 mm. and height of 305 mm. were cast and tested under compression. The average compression strength obtained on the samples was 39.68 MPA and the average Young's modulus was 30.18 GPA.

According to the manufacturers data, the nominal tensile strength of the fibre-reinforced polymer utilized was 2300 MPA and the nominal Young's modulus of the fibre-reinforced polymer was 76 GPA with the nominal thickness per layer of the fibre-reinforced polymer being 0.17 mm.

The samples to be tested were placed in a testing machine under displacement control with a loading rate of 0.003 mm. per second.

All the specimens experienced continuous load-displacement behaviour until failure of the specimen took place at which time the fibre-reinforced polymer outer tube ruptured and the load began to drop.

The load-strain behaviour of the six double-skin tubular column samples is shown in FIG. 4.

It can be seen from FIG. 4 that the two and three-layer double-skin tubular columns show bi-linear load-strain curves while the single layer double-skin tubular columns show approximately elastic-plastic behaviour.

All specimens show large ductility.

Referring to FIG. 5, a comparison is made to show the strength and ultimate axial strain enhancement of the specimens compared with plain concrete.

It can be seen that even for the columns carrying a single layer of fibre-reinforced polymer, there was little increase in strength but with a significant enhancement in ultimate strain showing a considerable enhancement of ductility of the structural member. This enhancement of ductility ensures an increased amount of energy may be absorbed before the structure collapses.

Those specimens carrying two or three layers of fibre-reinforced polymer show a significant increase in ultimate strength as well as further enhancements in the ultimate axial strain compared with the strain at peak stress of unconfined concrete.

Thus it can be seen from these experiments that structural members utilizing a double-skin of fibre-reinforced polymer and a metallic compound such as steel may provide structural members having an improved response to absorb the energy of earthquakes even beyond structural failure of the column itself. Furthermore, increased layers of fibre-reinforced polymer showed an increased ductility to carry load after initial failure of the column.

A resulting column or other such structural member may be relatively easy to construct while highly resistant to corrosion, fire and earthquakes.

Aside from the increased ductility, the provision of a fibre-reinforced polymer outer skin is less acceptable to corrosion than steel or other metallic outer layers. Furthermore, the fibre-reinforced polymer tube provides confinement to the concrete and increased ductility as well as a form during construction to allow further construction to continue even while the concrete cures to reach its ultimate strength. The use of the steel inner tube will provide some significant strength to the column during this construction phase while the concrete cures.

The provision of the steel inner tube also allows relatively easy interconnection with other structural members such as for the interconnection of beams and columns or columns and floor slabs. The inner steel tube, particularly provided without a filler, may allow steel to be run from an interconnecting beam or floor slab into the steel tube and welded against stiffeners fitted to the inner steel tube. This is typical for existing columns utilizing steel tubes.

It should also be noted that the inner tube may be appropriately stiffened and/or provided with shear connectors to ensure composite action with the filler material if desired.

Although the inner tube is generally described as a continuous tube, it may be provided in a variety of sections or as a plurality of tubes whether concentrically or otherwise arranged.

The provision of the fibre-reinforced polymer outer tube and the increased ductility provides a greater earthquake response. Furthermore, the material is relatively light so does not significantly add to the weight of the overall column. The fibre-reinforced polymer tube may be provided as a sacrificial layer in the case of fire and may be replaced upon reconstruction after a fire. As this outer tube is not providing any significant structural strength during normal loading of the column, there is no need to fire protect this outer layer.

The use of the inner steel tube provides a steel tube that is protected from corrosion by the outer layers and also protected from fire.

Thus it can be seen that structural members formed in this manner may provide a variety of advantages over existing structural members.

This description has made reference to specific embodiments in an illustrative manner and the invention should be considered broadly in accordance with the general disclosure. Any specific integers referred to throughout the description are deemed to incorporate known equivalents where appropriate.

The invention claimed is:

1. A double-skin tubular structural member including:

a fibre reinforced polymer outer tube including a majority of fibres oriented generally circumferentially around said fibre reinforced polymer outer tube said fibers including at least one of a carbon, glass, aramid and resin material;

an steel inner tube, said steel inner tube being hollow; and a concrete filler material provided between said outer tube and said steel inner tube, wherein said fibre reinforced polymer outer tube is formed along an entire length of said steel inner tube.

2. A double-skin tubular structural member as claimed in claim 1 wherein said outer fibre-reinforced polymer tube is constructed from a plurality of layers of fibre-reinforced polymer.

3. A double-skin tubular structural member as claimed in claim 1 wherein said outer fibre-reinforced polymer tube is constructed using a filament winding process.

4. A method of constructing a double-skin tubular structural member comprising the steps of:

providing a pre-formed fibre reinforced polymer outer tube including a majority of fibres oriented generally circumferentially around said fibre reinforced polymer outer tube, said fibers including at least one of a carbon, glass, aramid and resin material;

providing a steel inner tube, said steel inner tube being hollow; and inserting concrete as a filler material between said outer tube and said inner steel inner tube;

wherein said fibre reinforced polymer outer tube is formed along an entire length of said steel inner tube.

5. A method of constructing a double-skin tubular structural member as claimed in claim 4 wherein said fibre reinforced polymer outer tube acts as a construction form during a curing stage of the filler material.

* * * * *